United States Patent [19]

Greenberg

[11] Patent Number: 4,659,082

[45] Date of Patent: Apr. 21, 1987

[54] MONTE VERDE PLAYING CARD DISPENSER

[75] Inventor: Joel S. Greenberg, Princeton, N.J.

[73] Assignee: Harold Lorber, Dresher, Pa.

[21] Appl. No.: 417,384

[22] Filed: Sep. 13, 1982

[51] Int. Cl.[4] ..... A63F 1/12

[52] U.S. Cl. ..... 273/149 R

[58] Field of Search ..... 273/148 R, 149 R

*Primary Examiner*—Leo P. Picard

*Attorney, Agent, or Firm*—Lerner, David, Littenberg, Krumholz & Mentlik

[57] ABSTRACT

A Monte Verde card dispenser of shoe is provided that simulates a card shoe containing a playing card deck or near infinite length. The card dispenser includes a rotary carousel containing a plurality of card carrying compartments around the periphery thereof. The cards area injected with the carousel from the input hopper and ejected from the carousel into an output hopper for use by the dealer.

13 Claims, 11 Drawing Figures

MONTE VERDE PLAYING CARD DISPENSER

BACKGROUND OF INVENTION

This invention relates to a playing card dispenser and more particularly to a playing card dispenser of the type that is herein designated to be a Monte Verde type. A Monte Verde card dispenser or shoe is one that provides a continuous shuffling of one or more playing card decks so as to effectively cause a playing card deck of a finite number of cards to simulate a deck having an infinite number of cards.

The Monte Verde continuous shuffling card dispenser is particularly applicable to the game of Blackjack or Twenty-One. It is applicable to other games such as Bacarrat.

At present, Blackjack or Twenty-One is one of the most popular card games played in gambling casinos throughout the world. The game is played by a wide variety of players ranging in ability from novices to card counting experts.

Even though different rules and techniques may apply in different casinos throughout the world, all games of Blackjack are fundamentally the same. The object of the game is quite simple, the player strives for a total that is higher than that achieved by the dealer without the player "busting". A player busts when his card total exceeds twenty-one, hence the game is sometimes also called "Twenty-One".

The mechanics of the game of Blackjack are relatively simple. A dealer, who is employed by a casino, deals in succession to each player and himself a first and then a second card. Each card from the deuce or 2 through ten (10) has a value corresponding to their face value. The picture cards king, queen and jack each have a value of ten whereas any ace may have a value of either one or eleven. Each player in succession is questioned as to whether or not he wishes an additional up card after being dealt the first two and he receives additional up cards until he stands or busts. His goal is to achieve a higher card value total than the dealer without busting, that is without exceeding a total of 21.

The player normally has a wide variety of playing options including:

1. When, where and duration of play.
2. Size of wager (from the house minimum to the house maximum), and
3. Complete freedom of choice in playing strategy within the house rules, including drawing, standing, doubling down, splitting pairs, varying wager size from hand to hand. The player also may have surrender and insurance wager options.

The player is disadvantaged in being forced to make his playing decisions before the dealer acts on his casino hand. Thus the player in playing first must surrender his hand and wager if his total exceeds 21 when drawing cards whereas the dealer does not return the player's wager if the dealer subsequently also busts. On the other hand, the dealer faces the disadvantage of being limited to a rigid predetermined strategy. The dealer must draw cards until he attains a specified total card value such as 17 or higher and then he must stand. Normally, the casino still has the better of the advantage and, absent extraordinary circumstances, wins more than it losses.

Mathematically inclined players have discovered a scheme that can outweigh the casino's advantage. This scheme is called "card counting". The game of Blackjack is dealt either from a "shoe" containing one or more card decks or out of hand by the dealer. As the cards are dealt, the deck composition (i.e., the cards remaining in the deck) can change radically. It is possible, by relatively simple counting techniques, to take advantage of the knowledge of the deck content in the determination of wager size and playing strategy (hit, stand, double down and other decisions). Most counting systems assign point values to the actual card values, with some of the cards being given positive values and others being given negative values. A running sum is maintained by the card counter of all of the cards that have been played. This sum, or "running deck value", is modified by the card counter to take into account the number of cards that have not yet been played, and yields the "true deck count". The magnitude of the true deck count provides an indication of the "richness" of the remaining deck for the player. It provides a measure of the likelihood of high value cards (i.e., tens and aces) being drawn. A high true deck count indicates an excess of high value cards in the cards remaining to be played and a low true deck count indicates an excess of low value cards in the cards remaining to be played. A Blackjack player that keeps track of these card counts, "the card counter", can adjust his wagering and playing decisions to take into account this additional information. Card counting and strategy adjustment according to card count can significantly alter the odds in favor of the card counting Blackjack player and against the casino.

In order for Blackjack to be a profitable venture for the casinos, it has been found to be necessary either to bar the card counters from the casino or to change the rules and procedures under which the game is played. It is obvious, particularly to those familiar with the game of Blackjack, that many rule and procedure changes are possible. However, not so obvious is the fact that rule and procedure changes have not been determined that satisfy the multiple objectives of (a) providing a profitable venture for the casinos with card counters playing and (b) not appreciably altering the game for the novice or basic player.

Barring card counters has precipitated a plurality of civil rights court actions. In addition to being expensive to conduct such ligations, it has been found that state gambling commissions have been reluctant to bar card counters and consequently casinos are in a quandry as to the best solution to this vexed problem.

One solution adopted by the casinos is to increase the number of decks utilized by the dealer in playing Blackjack. Thus six or eight decks are commonly utilized and dealt from a card dispenser or shoe. As the cards are removed from the shoe they are utilized in the play of the hands and then placed in a discard rack. When a cut-card marker is encountered, the cards remaining in the shoe plus those in the discard rack are shuffled and then replaced in the shoe. Thus the "richness" of the deck is substantially reduced limiting a card counter's ability to predict the remaining cards and hence affect his strategy of play. The disadvantage of such a technique with respect to the casino is that shuffling six or eight decks takes a relatively long time, which reduces the play and hence the profits of the casino.

SUMMARY OF THE INVENTION

In accordance with the invention, there is provided a Monte Verde card dispenser or shoe. Such a Monte Verde shoe simulates a card shoe containing a playing card deck of near infinite length. Such a card dispenser effectively foils a card counter because the residue of unplayed cards in the deck never achieves a significant richness of cards of either low or high values. Thus a card counter's strategy is rendered substantially useless by the invention.

PREFERRED EMBODIMENT OF THE INVENTION

A Monte Verde card dispenser includes a rotary carousel containing a plurality of card carrying compartments around the periphery thereof. Cards are injected into the compartments in sequence or at random, as in the preferred embodiment from an input card hopper mounted adjacent the periphery of the carousel. A dealer inserts played cards from each hand or round into the hopper. The carousel is rotated around its central axis in steps with each step corresponding to one of its card carrying compartments. Cards are withdrawn one-by-one from an output card hopper by a dealer during play and an output card ejecter ejects cards from the card carrying compartments in sequence or at random as in the preferred embodiment, to insert the cards into the output hopper. The substantially continuous random insertion and removal of the playing cards from the carousel effectuates a substantially continuous shuffling of the playing cards, which frustrates card counting strategies.

DETAILED DESCRIPTION OF THE INVENTION

Figures 1, 3A:
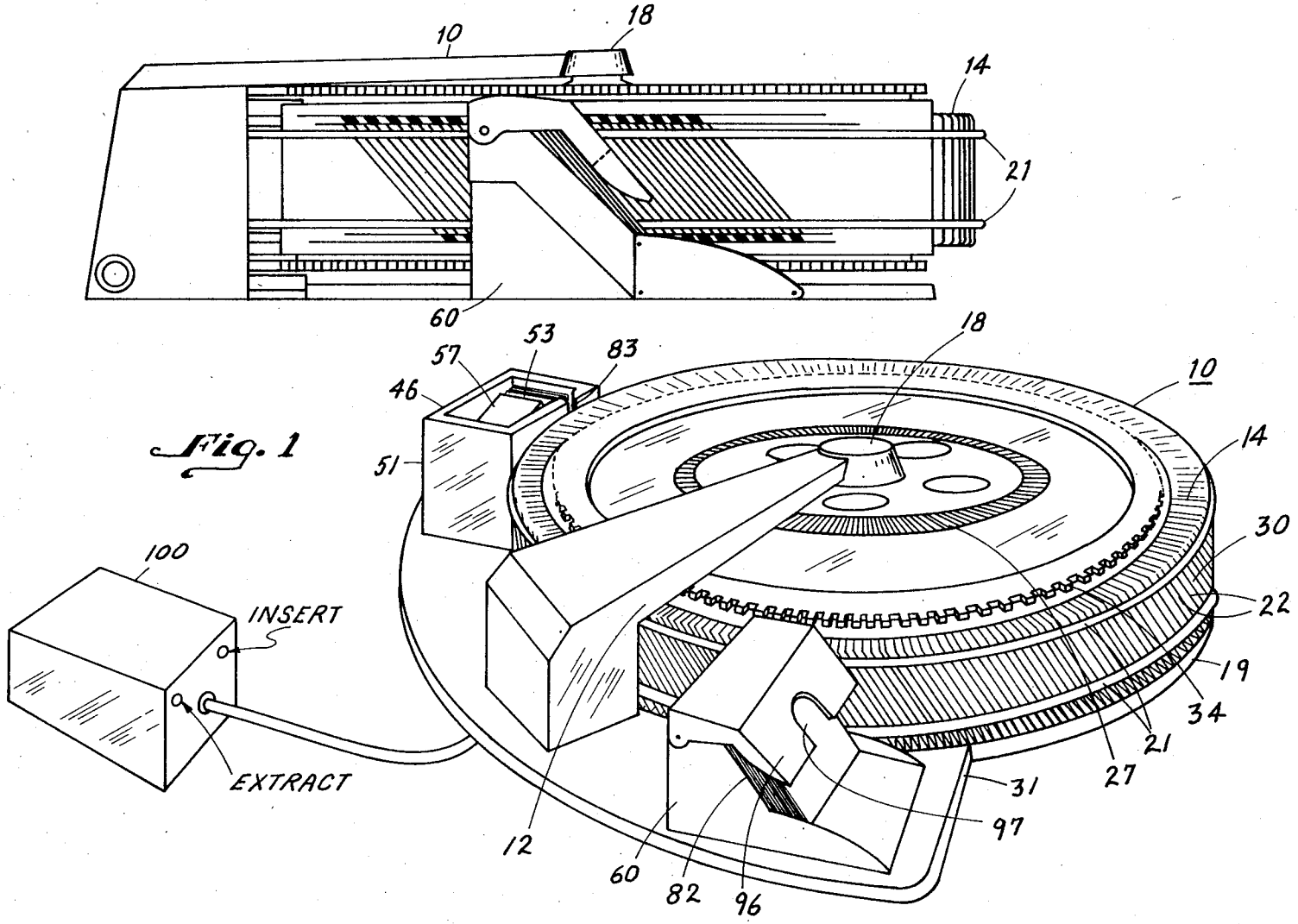
FIG. 1 is an isometric view of a Monte Verde card dispenser.
FIGS. 3 and 3A are partial side views of the card dispenser of FIG. 1.
Figure 2:
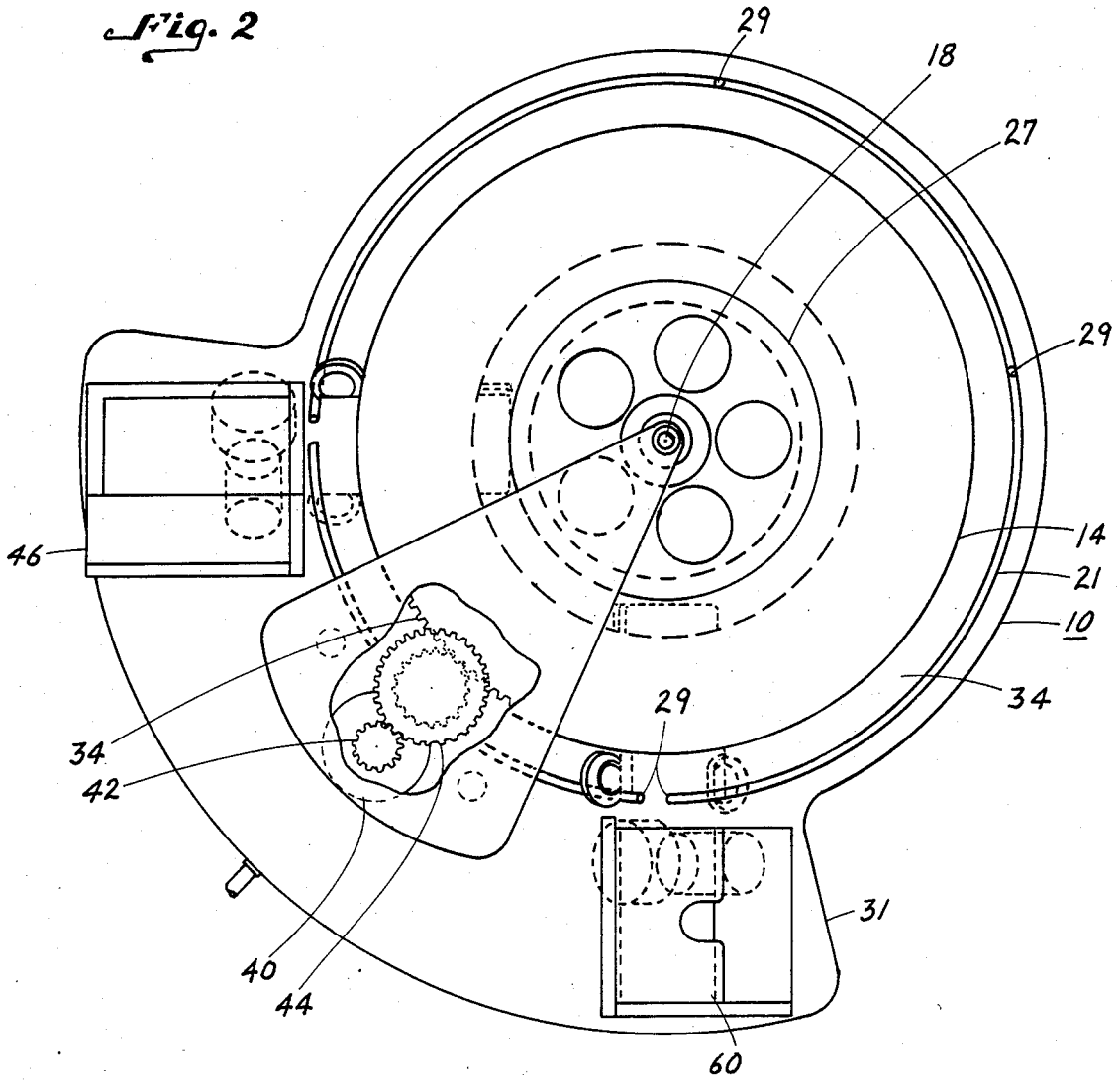
FIG. 2 is a top view of the card dispenser of FIG. 1.
Figure 3:
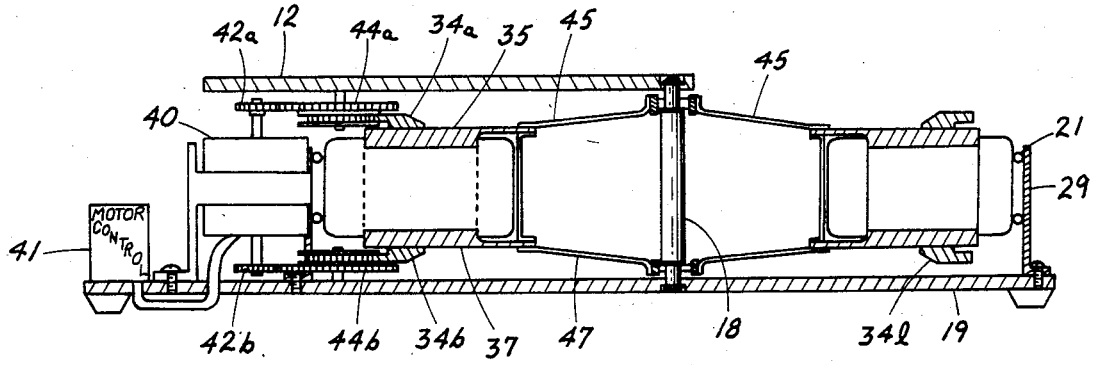

Referring to FIGS. 1, 2, and 3, there is shown a Monte Verde card shoe 10 in accordance with the invention. The card shoe or dispenser 10 includes a rotary carousel 14 having a central shaft or spindle 18 located along its central axis of rotation. The central shaft 18 is supported by a base member 19. The carousel 14 includes a plurality of partitions or walls 22 that extend radially from the hollow central portion 15 of the carousel 14 to the outer circumference 26 thereof. A circular back plate 27 along with the partitions 22 define card compartments 30. There are 216 card compartments so as to provide for four decks of cards which total two hundred and eight cards with eight compartments being left vacant when all cards are inserted into the compartments 30.

An annular ring gear 34 surrounds the perimeter 26 of the carousel 26 and a stepping motor 40 is positioned to drive the ring or driven gear 34 via intermediate gears 42 and 44. The gear 44 is a dual gear to match the stepping motor 40 to the spacing of the compartments of the carousel 10. The gear 42 is mounted on the shaft of motor 40. The ring gear 34 under the control of the motor 40 steps the carousel 14 around in a counterclockwise direction and each step of the ring gear 34 corresponds to one of the compartments 30.

As shown in FIG. 3, the ring gear 34 includes an upper gear **34*a* fastened to an upper plate or disc 35 of the carousel 14 and a lower gear 34*b* fastened to a lower plate or disc 37 of the carousel 14. Similarly driving gear 42 includes an upper gear 42*a* and a lower gear 42*b* and intermediate gear 44 includes a dual upper gear 44*a* and a dual lower gear 44*b*. The motor 40 is supported between the base member 19 and a bracket 12. The bracket 12 is integrally connected to the base member 19 and a spindle or central shaft 18 is supported there between. The spindle 18 supports upper and lower covers 45 and 47 of the carousel 10. The upper and lower plates 35 and 37 are supported by the upper and lower covers 45 and 47** respectively.

As further shown in FIG. 3 a card compartment 30 contains a card 31 therein and the card 31 is held inside the compartment 30 by a pair of retaining rings 21. As shown in FIG. 2 the retaining rings 21 include openings adjacent an input hopper or injector 46 and an output hopper or ejector 60. The retaining rings 21 are supported by upright posts 29, which define the openings in the retaining rings 21, and the posts 29 are mounted in apertures in the base plate 19. The base plate 19 also includes a flange 31 to which the input and output hoppers 46 and 60 are mounted. The openings in the retaining rings permit cards to be inserted into the carousel 10 and ejected therefrom.

Figure 4:
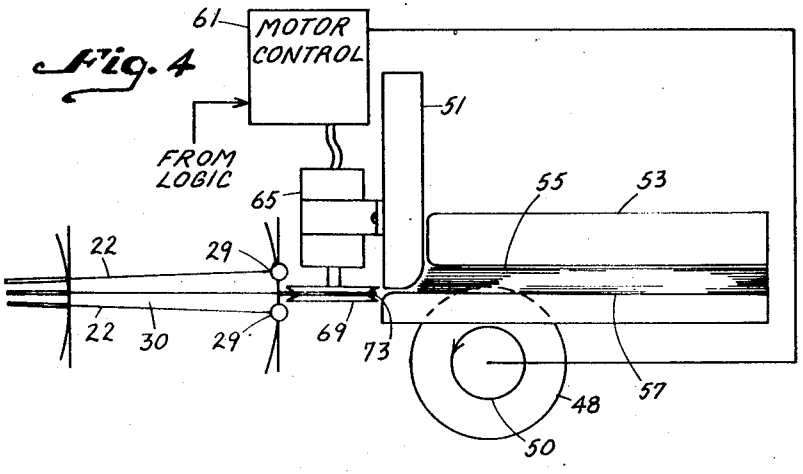
FIG. 4 is an angled top view of the card injector of FIG. 1.
Figure 5:
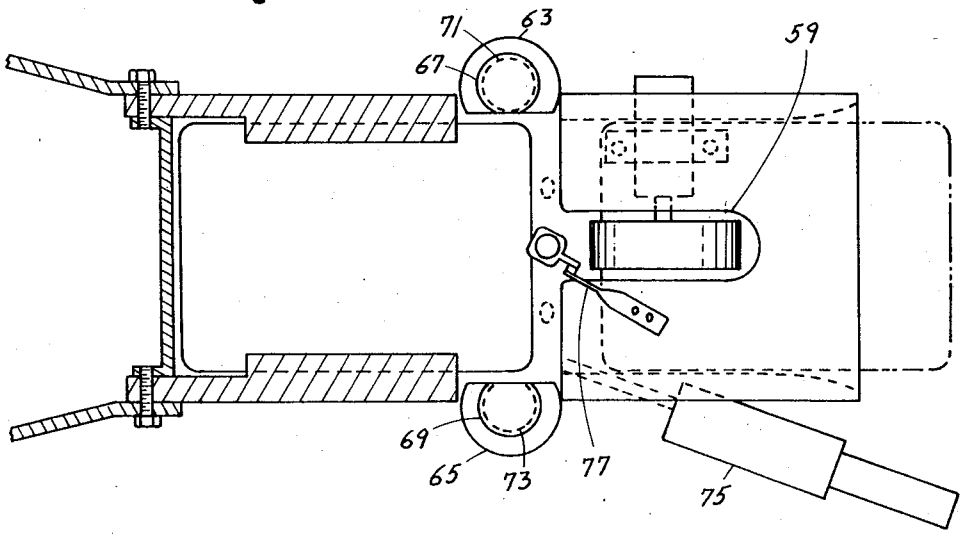
FIG. 5 is a bottom view of the injector of FIG. 4.

The input hopper or injector 48 receives discards from a dealer after a hand or round has been played. The input hopper 46 includes a housing 51, which is open on the upper side, and which also includes a surface that is sloped or angled to match the slope or angles of the side walls of the card compartments 30 of the carousel 10. Discards 55 are inserted face down by the dealer onto the sloping wall 57 as shown in FIG. 4. An opening on the sidewall 51 of the hopper 46 matches the slope of the side walls 22 of the card compartments 30, and the sloping wall 57, and is located adjacent thereto so that a card can be slid out of the hopper 46 through the opening in the sidewall 51 into the compartment 30. The sloping wall 57 of the input hopper has a bottom slot of opening 59, as shown in FIG. 5, which permits a card to be extracted from the input hopper 46 by a friction wheel 48. The friction wheel 48 is rotated by motor 50 to slide a card into a compartment 30. The discards are positioned against the friction wheel 48 by the pressure plate 53. The friction wall 48, which may for example be made of elastomeric material, is mounted on the shaft of motor 50 and the motor is rotated under the control of a motor controller 61.

When a discard is slid out of the input hopper by the friction wheel 48, a pair of card edge drive wheels 63 and 65 grasp each edge of a card and propel the card into an empty compartment 30 of the carousel 10. The drive wheels 63 and 65 are mounted on the drive shafts of the motors 67 and 69 respectively and are rotated by these motors. The motors 67 and 69 are controlled by the motor controller 61. The drive wheels 63 and 65 are positioned to be one card width apart and are slotted so that one side edge of a card fits into the slot 71 of drive wheel 63 whereas the opposite edge of the same card fits into the slot 73 of the wheel 65. An arcuate portion of each drive wheel 63 and 65 is removed so that the wheels 63 nd 65 receive a card in their slots and propel the card for the portion that the circumferences of the wheels 63 and 65 are uniform and then expel the card into the compartment 30 when the arcuate cut is reached. A sensor 75 detects when a compartment 30 is filled and a sensor 77 detects when a discard is in the hopper 46.

The card dispenser 10 also includes a card ejector 60. The ejector 60 includes an output hopper 81 wherein a plurality of cards ready to be played are stored. The hopper may for example contain fourteen cards and a sensor 99 (FIG. 7) detects when the number of cards drops below this number so that additional cards are ejected into the hopper 81.

Figure 6:
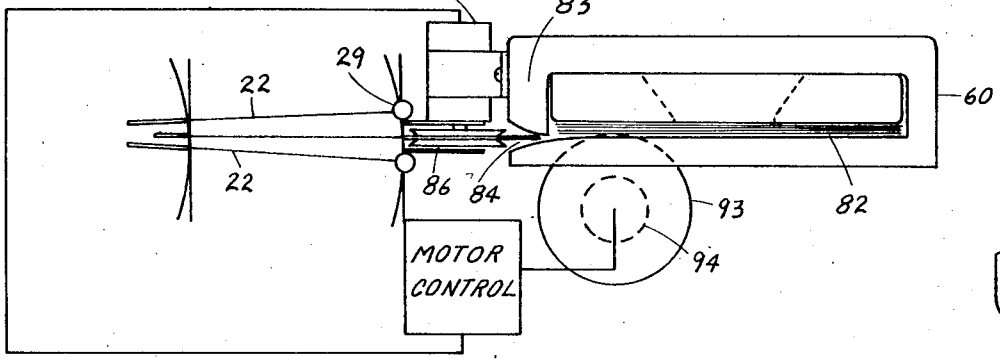
FIG. 6 is an angled top view of the card ejector of FIG. 1.
Figure 7:
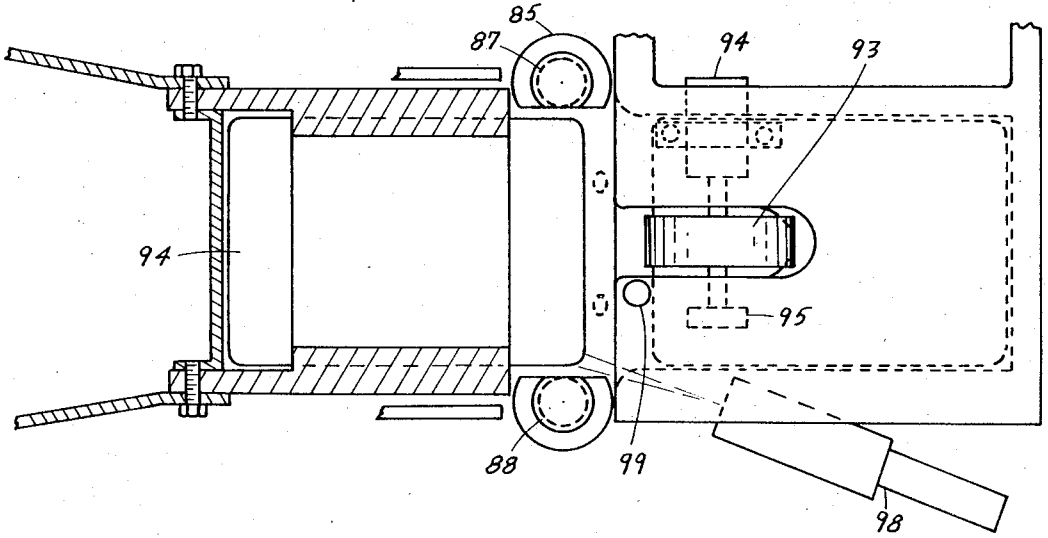
FIG. 7 is a bottom view of the ejector of FIG. 6.

The output hopper or shoe 60 includes an angled surface 82 onto which cards from compartments 30 are propelled. The angle is the same as the angled compartments 30 of the carousel 14,-which may for example be 45°. The ejection of cards from the compartments 30 of the carousel 14 into the output hopper 60 is the opposite of the injection of cards from the input hopper 46 into the compartments 30. Thus as shown in FIG. 6, a sidewall 83 of output hopper 60 includes an aperture 84 through which a card from a compartment 30 may be slid. A card is extracted from a compartment 30 by a pair of drive wheels 85 and 86 each of which includes a slotted portion into which a card fits. As shown in FIG. 7 each wheel 85 and 86 includes an arcuate portion which is removed so that cards in compartments 30 may pass between the wheels 85 and 86, when the carousel is rotated. However, when motors 85 and 88, whose shafts are coupled to drive the wheels 85 and 86 respectively, are activated by a motor controller 89 the drive wheels 85 and 86 are mounted to contact a card when they are rotated. Thus the circumferential slots contact and pick up the edges of a card 91 and project it into the output hopper 60. Consequently the drive wheels 86 and 87 are positioned one card width apart.

Figure 8:
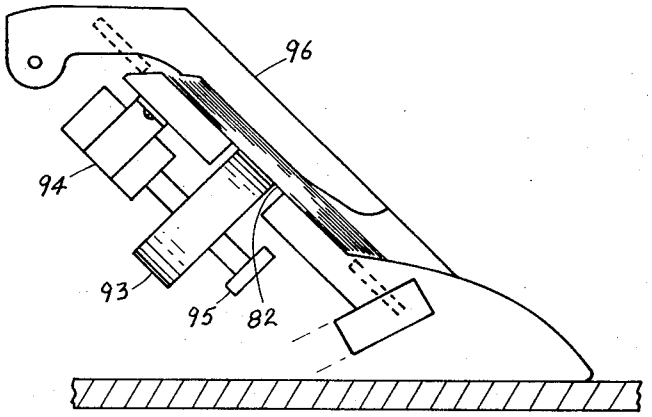
FIG. 8 is a side view of the ejecter of FIG. 7.

The leading edge 91 of the surface 82 is chamfered so that a card from a compartment 30 can be slid under the stack of cards in the output hopper 60 that are waiting to be dealt, as shown in FIG. 6. The chamfer edge 90 permits a card to be projected just below the leading edges of the stack of cards in the output hopper 60. A friction wheel 93 is mounted adjacent the chamfered edge 90 of hopper 60 to rotate and slide the card 94 into the hopper 60 under the other cards in the stack. Thus an aperture or slot is created in surface 82 to permit the friction wheel 93 to contact the under surface of the card. The friction wheel 93 is driven by a motor 94 to whose shaft it is coupled and a support wheel 95 is also coupled to the shaft of motor 94 so as to provide balance. The motor 94 is also controlled by the controller 89. A restraint cover 96 (FIG. 8) keeps the cards from moving away from the friction wheel 93. The restraint cover 96 includes a finger slot 94 permitting the extraction of a card by the dealer.

Figure 9:
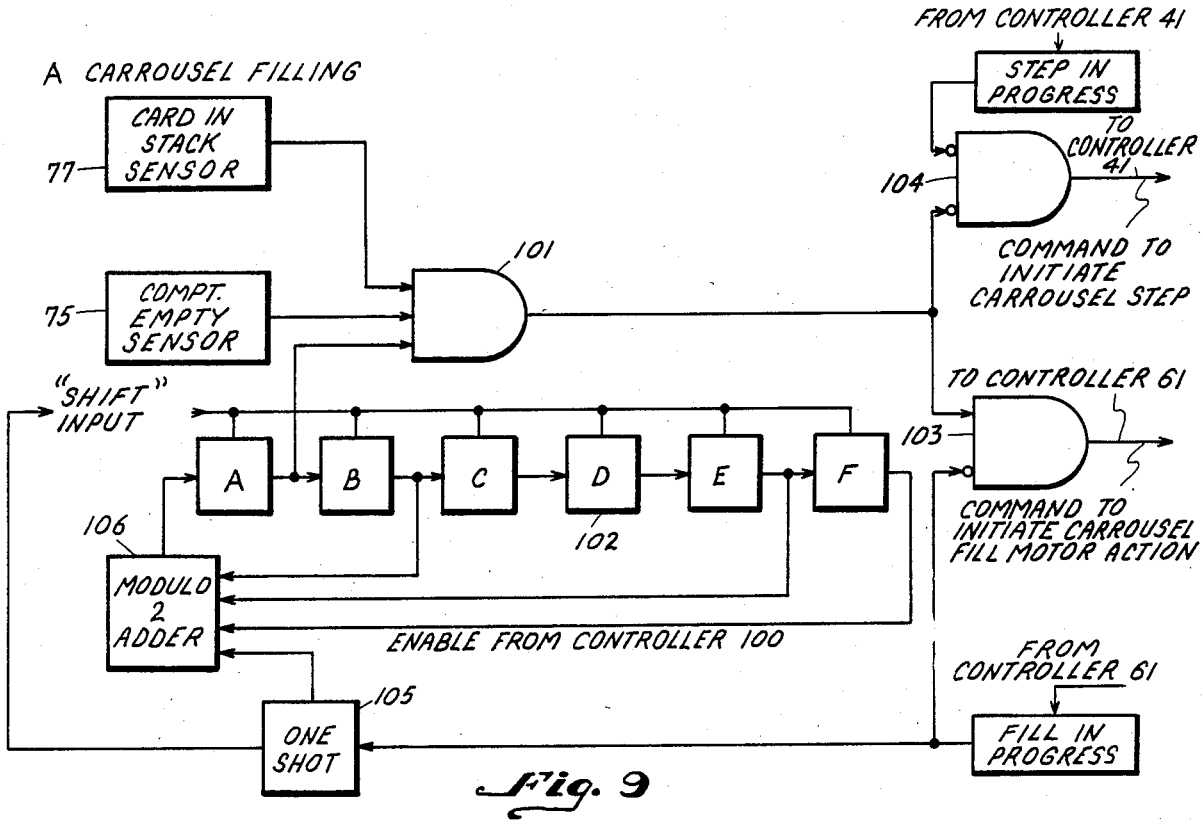
FIGS. 9 and 10 are logic diagrams illustrating the technique of introducing random injection and ejection of cards into and from the carousel of FIG. 1.
Figure 10:
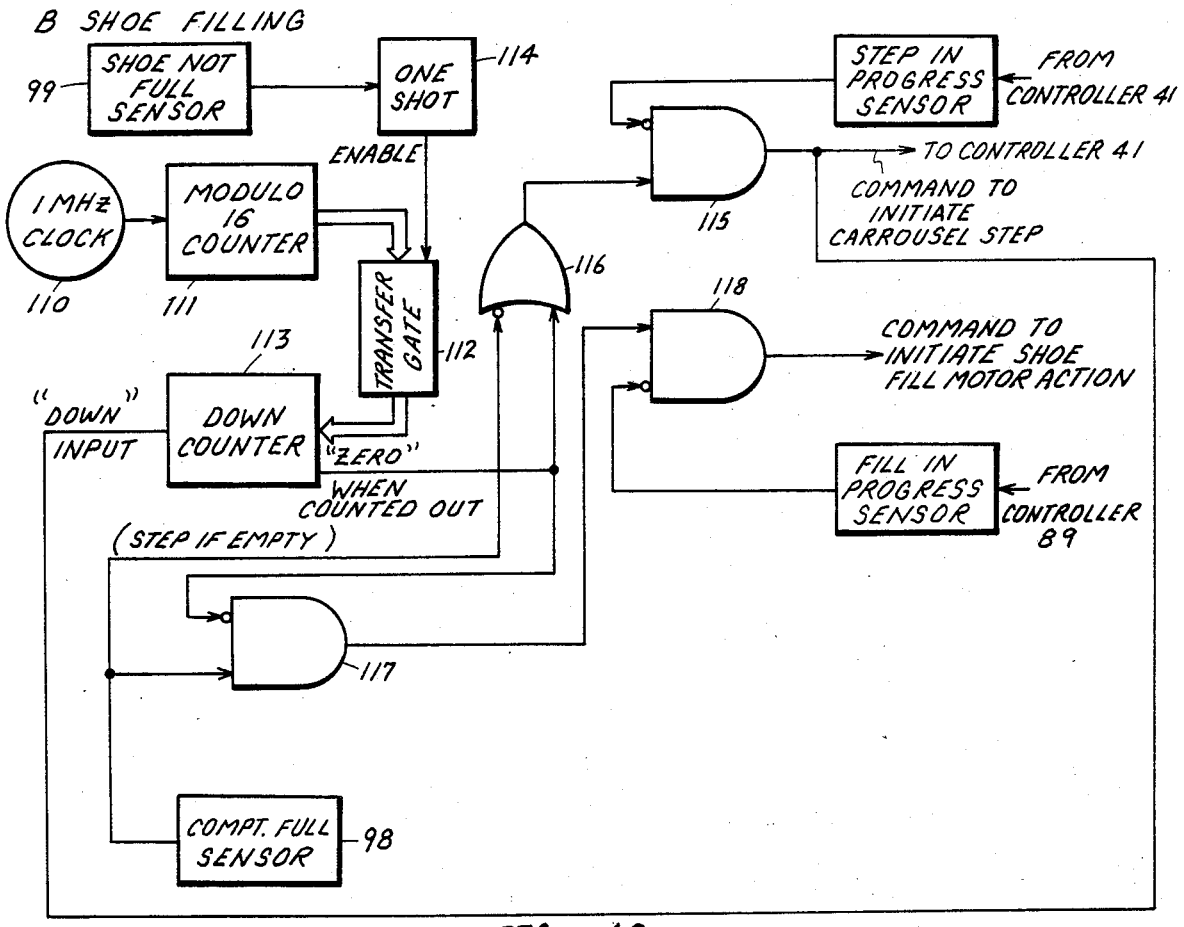

The logic circuits that determine into which empty compartment a card is injected and from which filled compartment a card is ejected are shown in FIGS. 9 and 10 respectively. It is to be noted that randomness is achieved in both the injection into and ejection from the carousel of the cards because the cards are inserted and extracted not from the next adjacent compartment but rather as determined by the logic controller 100. It is apparent that one or the other of the injection and ejection could be random and the other one constant but in the preferred embodiment both injection and ejection are substantially random.

In FIG. 9, there is shown the logic for injection of cards into the compartments 30 of the carousel 14, in a substantially random manner. The sensor 77 (FIG. 5) detects when a discard is in the input hopper 46 and the sensor 75 detects when a compartment 30 is empty. The sensors 75 and 77 may for example be retroflective sensors wherein the presence or absence of light reflected back from a card is detected and an appropriate output signal is provided. An AND gate 101 is activated under these conditions when the output of the first or A stage of a shift register 102 also contains a "1" or enabling signal. The AND gate 101 applies an enabling signal to AND gate 103. The gate 103 is activated when controller 61 signals the absence of the operation of motor 65. This is designated by the inhibit terminal of AND gate 103. Consequently a command goes to motor controller 61 to turn on motor 50 and remove a card from input hopper 46 by friction wheel 48. Motor controller 61 then turns on motor 65 and causes a card to be inserted into an empty compartment 30 by drive wheels 63 and 69. The AND gate 101 is disabled by the card inserted into the compartment by the signal from sensor 75 and consequently AND gate 104 is activated. This is because gate 104 includes two inhibit input terminals, designated by the small circles, and is only activated in the absence of a signal from gate 101 and the absence of a signal from controller 41. This absence designates that the motor 40 is inactive. Thus AND gate 104 turns on and activates motor controller 41 to cause motor 40 to step the carousel 14 one compartment step. It is important to note that the motor 40 is a stepper motor that steps the carousel 14 around in one compartment increments. This permits the compartments 30 to line up with cards being inserted and extracted from the carousel. The controller 61 deactivates gate 103 after a card is inserted and a one shot multivibrator 105 is fired which causes all of the binary numbers in the stages A through F of the shift register to shift down one stage.

The combination of the modulo 2 adder 106 providing the input to the shift register 102 with the outputs of the B, E and F stages providing inputs to the adder 106 provides a substantially random output signal from the A stage of the register 102. This provides a substantially random insertion of cards into the compartments 30.

In FIG. 10, there is shown the logic circuit for substantially randomly extracting cards from the compartments 30 in carousel 14 and inserting them into the output hopper 60. A one mega hertz clock 110 steps a modulo 31 counter 111 and the particular count in the mod 32 counter is transferred via transfer gates 112 to a down counter 113 when a one shot multivibrator 114 is activated. The multivibrator 114 is activated by the sensor 99 detecting the absence of cards in the output hopper 60. The down counter 113 is down counted to zero by the pulse output of AND gate 115. Simultaneously AND gate 115 is stepping the motor 40 the same number of steps by signaling the motor controller 41. The gate 115 is repeatedly activated by OR gate 116 because down counter 113 is providing a "1" output until counted down to "0". When "0" is derived from counter 113 OR gate 116 to deactivated if sensor 98 detects that a compartment is filled. This is because the second input to the OR gate 116 is an inhibit input. If the compartment is empty the carousel 14 would be stepped again. The sensor 98 activates AND gate 117 when the compartment contains a card and counter 113 is down counted to zero. The AND gate 117 therefore enables output AND gate 118 to signal motor controller 89 to turn on motors 87 and 88 and cause drive wheels 85 and 86 to extract a card from a compartment 30 and partially insert it into output hopper 46. The motor controller 89 turns off motors 87 and 88 after they have ejected a card and then turns on motor 94 to cause friction wheel 93 to slide the card entirely into the output hopper 60.

Thus it can be seen that any number, for example 0 to 32, is randomly selected from the counter 111 and the carousel 14 is stepped this number of compartments. If no card is in the compartment selected, the carousel 14 is stepped another random number until a filled compartment is reached and a card selected therefrom.

The logic circuits are contained in logic controller 100 which also includes push buttons permitting a dealer to initiate insertion and extraction at his command.

OPERATION

The objectives of the continuous shuffle device (the Monte Verde Shoe) are to: (1) significantly reduce the variability of true count (a measure of the chance of high cards being dealt relative to the chance of low cards being dealt) and (2) eliminating the need for the shuffling of cards. Reducing the variability of true count is aimed at reducing the card counter player advantage over the casino. Eliminating the need for shuffling cards is aimed at increasing the productivity (hands played per hour) at a Blackjack or Baccarat table.

To understand how card counting strategy is frustrated by the invention, it is necessary to know the concept of card counting. What a non-card counter basic strategy player would do in certain circumstances and what a card counter would do in the same circumstances are shown in Tables 1 and 2. The non-card counter basic strategy player is defined as a player who tends to make optimum decisions without knowledge of the true count or richness of the remaining cards. For example, a basic strategy player holding a hard total of 12 against a dealer up card of 4, 5 or 6 will stand (not draw another card) independent of the point count. The same player with a hard 12 will hit (draw a card) against a dealer up card of 2, 3, 7, 8, 9, 10, A. The specific decisions embodied in the basic strategy maximize the players win percentage. Players not followin such a strategy will lose at a higher rate. A card counting player who keeps track of the deck composition or point count can significantly increase the win percentage above that of a basic strategy player.

The highest level skill of a player is one who follows a card counting strategy for both play variations and for betting behavior. While the number of card counting strategies is quite large and based upon different levels of complexity, one technique represents the strategy needed to understand the current invention.

TABLE 1

NON-CARD COUNTER BASIC STRATEGY
(PLAYER TOTAL = 12)

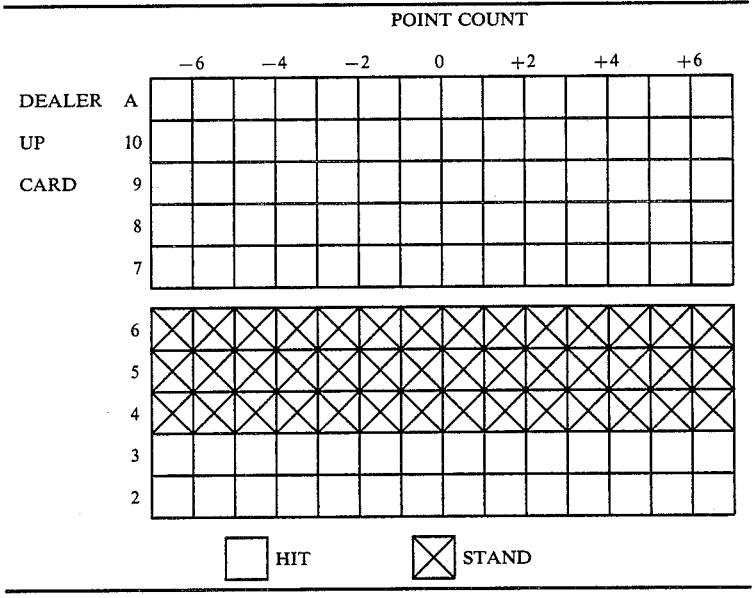

TABLE 2

SIMPLE POINT COUNT STRATEGY
(PLAYER TOTAL = 12)

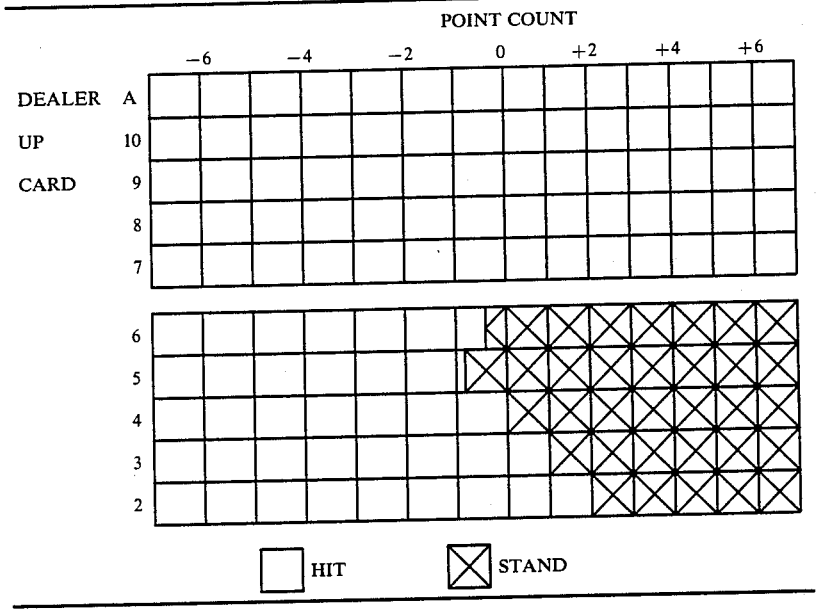

The card counting technique described is the "Dubner" high low count which assigns a value of +1 to the cards 2, 3, 4, 5, 6, a value of 0 to the cards 7, 8, 9 and a value of −1 to the cards 10, Jack, Queen, King and Ace. The card counter utilizes information concerning the cards remaining in the dealer shoe to his advantage. By using a strategy such as the high low strategy above, the card counter has better information on the composition of the cards remaining in the shoe. If there is an excess of high cards in the shoe, then the dealer with his fixed strategy will be busting more frequently and the card counter should play more conservatively. If there is an excess of low cards remaining, then the dealer will bust less frequently and the player is forced to try to get a higher total than the dealer. The excess or defficiency of high cards in the deck is used to the card counter's advantage in both betting and playing decisions.

The card counter utilizes the favorability of the unplayed cards in the shoe to determine the size bet to place. Typically a card counter may play all hands, and bet a unit bet (minimum bet) whenever the count is unfavorable, and bet heavily whenever the count is favorable.

A major portion of the card counter advantage is gained by betting when conditions are favorable. The intent of all of the betting strategies is to maximize the bets in the most favorable situations and to minimize the bets in the most unfavorable situations. One possibility that counters employ is to not play the unfavorable situations at all and to play only when the count exceeds some positive number. In these situations, the counter potentially plays fewer hands per hour. However, the expected gain per hand is always positive. This latter strategy of betting only the favorable situations is called shadow counting and is employed heavily in the concept of team play. Thus in the situations of Tables 1 and 2 wherein the player each has a card count of 12, the card counter would stand in situations wherein the basic player would request another card. Furthermore the more the count becomes positive the more the card counter would bet while standing. Card counting is so successful that mathematicians have formed groups to exercise their strategies. In most situations, they will win.

The effect of taking advantage of knowledge of the true count is illustrated in Table 3 when playing against Atlantic City Blackjack rules (June 1982) and dealing from a six deck shoe with a 33 percent cut card location (four of the six decks are dealt). The result, with the indicated bet sizes, is that the card counter is expected to earn $2.11 per hand (there are typically 70 to 80 hands per hour).

Table 4 is similar to Table 3 except that it is based upon the true count probability distribution from the Monte Verde Shoe, as simulated by a computer. The result, with the indicated bet sizes, is that the card counter is expected to earn $0.04 per hand. As before, the true count is the running count divided by the number of half decks remaining where the number of half decks remaining is computed according to the following:

$$\text{No. of Half-Decks Remaining} = \left[ 52 \times D - MAXB - \text{Integer}\left\{ \frac{52 \times D \times \delta \times \alpha}{AST} \right\} \right] / 26$$

where

MAXB = number of cards in the buffer

D = number of decks of cards utilized $\delta$ = number of slots divided by the number of decks multiplied by 52 ($\delta \geqq 1$)

$\alpha$ = fraction of the number of slots between the inject and eject locations AST = average step size (number of slots between successive selections of cards for ejection).

In the above computation of the number of half decks remaining it is assumed that the card counter has complete knowledge of the operational characteristics of the Monte Verde Shoe.

TABLE 3

PLAYING CARD COUNTER AVERAGE WIN/HAND WITH CURRENT ATLANTIC CITY RULES AND A SIX-DECK SHOE WITH A 33 PERCENT CUT CARD LOCATION ($10 TABLE)

| TRUE COUNT, N | PROB. OF TRUE COUNT, p(N) | WIN PERCENTAGE, w(N) | BET SIZE, B(N) | EXPECTED WIN, $* |
|---|---|---|---|---|
| −7 | .001 | −7.00 | $10 | −.00 |
| −6 | .004 | −6.00 | 10 | −.00 |
| −5 | .009 | −5.00 | 10 | −.01 |
| −4 | .021 | −3.00 | 10 | −.01 |
| −3 | .041 | −2.00 | 10 | −.01 |
| −2 | .085 | −1.50 | 10 | −.01 |
| −1 | .156 | −1.00 | 10 | −.02 |
| 0 | .362 | −0.45 | 10 | −.02 |
| 1 | .156 | 0.10 | 500 | .08 |
| 2 | .085 | 0.50 | 1,000 | .43 |
| 3 | .041 | 1.40 | 1,000 | .57 |
| 4 | .021 | 2.40 | 1,000 | .50 |
| 5 | .009 | 3.60 | 1,000 | .32 |
| 6 | .004 | 5.40 | 1,000 | .21 |
| 7 | .001 | 7.50 | 1,000 | .08 |
| | | EXPECTED WIN/HAND, $ | | 2.11 |

*EXPECTED WIN/HAND = $\sum_{N=-7}^{+7} p(N) \times w(N) \times B(N)$.

TABLE 4

PLAYING CARD COUNTER AVERAGE WIN/HAND WITH CURRENT ATLANTIC CITY RULES AND UTILIZING THE MONTE VERDE SHOE ($10 TABLE)

| TRUE COUNT, N | PROB. OF TRUE COUNT, p(N) | WIN PERCENTAGE, w(N) | BET SIZE, B(N) | EXPECTED WIN, $* |
|---|---|---|---|---|
| −7 | .0000 | −7.00 | $10 | −.00 |
| −6 | .0000 | −6.00 | 10 | −.00 |
| −5 | .0000 | −5.00 | 10 | −.00 |
| −4 | .0000 | −3.00 | 10 | −.00 |
| −3 | .0000 | −2.00 | 10 | −.00 |
| −2 | .0012 | −1.50 | 10 | −.00 |
| −1 | .1640 | −1.00 | 10 | −.02 |
| 0 | .6800 | −0.45 | 10 | −.03 |
| 1 | .1540 | 0.10 | 500 | .08 |
| 2 | .0008 | 0.50 | 1,000 | .01 |
| 3 | .0000 | 1.40 | 1,000 | .00 |
| 4 | .0000 | 2.40 | 1,000 | .00 |
| 5 | .0000 | 3.60 | 1,000 | .00 |
| 6 | .0000 | 5.40 | 1,000 | .00 |
| 7 | .0000 | 7.50 | 1,000 | .00 |
| | | EXPECTED WIN/HAND, $ | | .04 |

*EXPECTED WIN/HAND = $\sum_{N=-7}^{+7} p(N) \times w(N) \times B(N)$.

One way to frustrate card counting is to constantly shuffle and reshuffle. However, this technique reduces playing time which reduces income for the casino. Card counting is rendered inoperative by the present invention because shuffling is being done substantially continuously. An initial shuffle is desirable but additional shuffles are not required since the cards from the discard rack are injected into and/or ejected from the carousel in a pseudo-random fashion.

The cards from the input hopper or discard rack are inserted into the carousel, which is momentarily stationary, using the injecter. Each card is placed in a separate compartment in the carousel. As the carousel rotates and momentarily stops, a card is ejected into the output hopper or inventory tray. A pressure plate maintains the temporary inventory cards in direct contact with the front of the shoe so that they may be easily withdrawn by the dealer.

Randomness of cards is obtained as follows. The carousel can be initially loaded manually with shuffled cards or it can be loaded by placing cards in the discard rack, injecting into the carousel and not dealing from the shoe. The carousel contains a large number of slots for example 216. All of the slots need not contain a card. Rates of injection and ejection need to average about one card per second. The speed of the carousel is achieved by using a stepping motor. This allows the number of steps (each step being equivalent to one compartment) to be easily controlled and the carousel slewed pass n slots before stopping on the specific slot from which a card is to be ejected. The number "n" is established in a random or near random fashion through the logic circuit. A sensor is provided to establish whether or not a slot contains a card. When a slot known to be empty passes the discard rack and there are cards in the discard rack and the logic determines randomly that a card is to be inserted, then the carousel stops momentarily and a card is inserted.

Thus the deck is constantly kept shuffled by effectively inserting discarded cards back into the deck in a pseudo-random fashion. Thus it is apparent that the objectives of keeping the deck near zero point count and eliminating the need for shuffling have been achieved.

The value of elimination of shuffling can be assessed as follows:

| | |
|---|---|
| Average BJ Revenue | 120,000 $/day |
| Play Duration | 18 hours/day |
| Average Time/Shoe | .17 hour |
| Average No. of BJ Tables | 50 |
| Average Shuffle Time | 1.5 min./shuffle |
| Shuffle Time/Table/Day | 2.65 hours |
| Average Revenue/Table | 133 $/hour |
| Revenue Loss/Table/Year due to Shuffling | 128,000 $/table/year |

What is claimed is:

1. A playing card dispenser comprising in combination: a rotatably mounted storage means having a plurality of compartments for holding said playing cards, first means for inserting discards into selected ones of said compartments, second means for extracting cards to be dealt from said selected compartments, and electronic logic means for randomly controlling one of said first and second means so that said playing cards are effectively being shuffled continuously by the random insertion or extraction from said storage means.

2. A dispenser in accordance with claim 1 wherein said storage means rotates in a substantially horizontal plane.

3. A dispenser in accordance with claim 2 that further includes a stepping motor that rotates said storage means a random number of steps each time a card is withdrawn and a random number of steps each time a card is inserted into said storage means.

4. A dispenser in accordance with claim 3 that further includes an input hopper for holding discards and an output hopper for holding an inventory of cards to be played.

5. A dispenser in accordance with claim 4 wherein said first means inserts a discard randomly from said input hopper into an empty compartment.

6. A dispenser in accordance with claim 4 wherein said second means ejects an unplayed card from a filled compartment randomly into said output hopper.

7. A dispenser in accordance with claim 5 wherein said first means includes a sensor for detecting the absence of a card in individual compartments and a first random number generator for selecting in a substantially random manner an empty compartment into which a card is inserted.

8. A dispenser in accordance with claim 7 wherein said first random number generator determines in a substantially random manner whether a card should be inserted into an empty compartment.

9. A dispenser in accordance with claim 6 wherein said second means include a sensor for detecting the removal of cards from said output hopper and a second random number generator for selecting in a substantially random manner a card filled compartment from which a card is ejected into said output hopper.

10. A dispenser in accordance with claim 9 wherein said second random number generator steps said stepping motor a random number of steps to select a compartment from which a card is ejected.

11. A playing card dispenser comprising in combination: a rotatably mounted storage means having a plurality of compartments for holding said cards, first means for randomly inserting discards into selected ones of said compartments, and second means for randomly extracting cards to be dealt from said selected compartments, whereby said playing cards are effectively being continuously shuffled.

12. A dispenser in accordance with claim 11 further including means for randomly controlling one of said first and second means.

13. A playing card shuffling apparatus comprising movably mounted storage means having a plurality of compartments for holding playing cards, and card supply means for inserting cards to be shuffled into selected said compartments and for extracting from selected said compartments cards to be dealt as said compartments are brought into registration therewith upon movement of said storage means.

* * * * *

UNITED STATES PATENT AND TRADEMARK OFFICE

CERTIFICATE OF CORRECTION

PATENT NO. : 4,659,082

DATED : April 21, 1987

INVENTOR(S) : Joel S. Greenberg

It is certified that error appears in the above-identified patent and that said Letters Patent is hereby corrected as shown below:

Column 6, line 8, change "retroflective" to --retroreflective--;

line 51, change "31" to --32--.

Signed and Sealed this

Twelfth Day of January, 1988

*Attest:*

DONALD J. QUIGG

*Attesting Officer*

*Commissioner of Patents and Trademarks*